US005605282A

United States Patent [19]

Snead

[11] Patent Number: 5,605,282

[45] Date of Patent: Feb. 25, 1997

[54] TIRE RAILROAD TIES

[76] Inventor: William B. Snead, P.O. Box 1000, Georgetown, Tex. 78627

[21] Appl. No.: 425,283

[22] Filed: Apr. 20, 1995

Related U.S. Application Data

[63] Continuation-in-part of Ser. No. 188,787, Jan. 31, 1994, abandoned.

[51] Int. Cl.[6] ..... E01B 3/00

[52] U.S. Cl. ..... 238/109; 238/115

[58] Field of Search ..... 238/109, 114, 238/115, 116, 117, 119, 2; 52/DIG. 9; 404/6, 7

[56] References Cited

U.S. PATENT DOCUMENTS

| | | | |
|---|---|---|---|
| 3,848,853 | 11/1974 | Way et al. | 52/DIG. 9 |
| 3,934,540 | 1/1976 | Bruner et al. | 52/DIG. 9 |
| 4,312,600 | 1/1982 | Schaaf et al. | 404/6 |
| 5,056,961 | 10/1991 | McMeans et al. | 52/DIG. 9 |
| 5,172,858 | 12/1992 | Frohn | 238/2 |
| 5,214,896 | 6/1993 | Hamilton | 52/DIG. 9 |
| 5,464,153 | 11/1995 | Broughton | 238/117 |

*Primary Examiner*—Mark T. Le
*Attorney, Agent, or Firm*—Vinson & Elkins, L.L.P.

[57] ABSTRACT

A railroad rail support system is provided which utilizes tire carcasses filled with annular concrete cores. Railroad rails are attached to the concrete tire carcasses by means of load distribution plates anchored to the concrete cores and hold-down clips which are attached to the load distribution plates and retain the rail flanges against lateral and excessive vertical displacement with respect to the load distribution plates. Gage bars may extend between opposed pairs of ties and be anchored in the concrete cores to retain proper gage spacing of the rails.

15 Claims, 4 Drawing Sheets

TIRE RAILROAD TIES

This application is a continuation-in-part of U.S. application Ser. No. 08/188,787 filed Jan. 31, 1994 now abandoned.

BACKGROUND OF THE INVENTION

The present invention is directed to a method and apparatus for constructing foundation elements for railroad rails from the concrete-filled carcasses of used automobile or truck tires. More broadly, the invention relates to concrete-filled tire carcasses for use as foundation elements for a variety of applications.

Railroad ties traditionally have been formed from wood infused with creosote as a preservative. However, the increasing scarcity and cost of wood suitable for use as railroad ties has lead to the investigation and increasing use of alternative railroad ties. More recently, concerns about the environmental impact of creosote used as a wood railroad tie preservative have given new impetus for the search for alternative railroad tie materials.

Most prior art non-wood railroad ties have comprised monolithic tie bodies formed of reinforced concrete. See, for example, U.S. Pat. Nos. 2,082,399; 4,802,623; 4,925,094 and 5,135,164. Because they are expensive to manufacture and because they have a tendency to abrade or stress fracture in use, railroad ties have found limited use in the United States. Where they are used, the metal plates which bind the rails to the ties and distribute the load on the ties have shown a tendency to abrade the concrete material of the ties. This has necessitated the use of rubber or other cushioning pads, sometimes called "rail pads," between the plates and the concrete ties, or between the rails and the plates, in order to extend the life of the concrete railroad ties. Such flexible rail pads have a tendency to degrade in use or to migrate away from the tie plates, necessitating inspection of the railroad lines and replacement of the rail pads at regular intervals.

At the same time, a significant ecological problem is presented by the accumulation of used automobile and truck tire carcasses which are very difficult to dispose of or to recycle into other uses. Attempts to recycle old tire carcasses for such uses, for example, as roadbed fillers, paving surfaces and raw materials for other useful articles have been largely unsuccessful due, in part, to the necessity for shredding the tires before they can be recycled into such other uses. The presence of strong steel or polymer reinforcing elements in the tire bodies makes shredding expensive and dangerous, and presents the necessity for separating the steel or other reinforcing elements from the crumb rubber before it is recycled for subsequent use.

SUMMARY OF THE INVENTION

It is, therefore, the primary object of the present invention to provide a railroad tie system which combines the desirable ecological and economic features of avoiding the use of creosoted wood ties while, at the same time, providing a recycling use for used tires without the necessity for shredding the tires.

Another object is to provide a foundation element based upon the use of concrete-filled tire carcasses, suitable for a variety of uses, including as railroad ties.

Another object is to provide a concrete-filled railroad tie which overcomes the rail abrasion problems of prior art concrete railroad ties.

In accordance with the present invention, a railroad tie system is provided which utilizes tire carcasses filled with concrete for carrying the weight of trains on rails, and for distributing that weight to the underlying roadbed of crushed stone. Preferably only the annular bodies of the tires are filled with concrete; the "holes" or center portions are left empty for receiving crushed stone ballast, which helps to stabilize the tires in the roadbed. The railroad rails rest on load distribution means which in turn rest on the concrete-filled tire bodies. Retaining means provide a mechanical connection between the rails resting on the load distribution means and the concrete cores inside the tire bodies. In the preferred embodiment, the retaining means comprise retaining clips holding the rails on the load distribution means and anchors attached to the load distribution means and extending through the sidewall portions of the tire bodies into the concrete cores. The individual tire ties supporting each rail of a railroad line preferably are attached in pairs by metal gage bars extending transverse to the rails and anchored in the concrete cores to assure retention of proper gage for the rails.

While the intended primary use of the invention is as railroad ties, it will be apparent to those skilled in the art that the same system could be used for a variety of inexpensive foundation purposes, replacing concrete or timber foundation elements now in use.

The objects and advantages of the invention will be apparent from the following detailed description of the preferred embodiment of the invention, and from the accompanying drawings, in which like numerals indicate like parts.

DETAILED DESCRIPTION OF THE INVENTION

Figure 1:
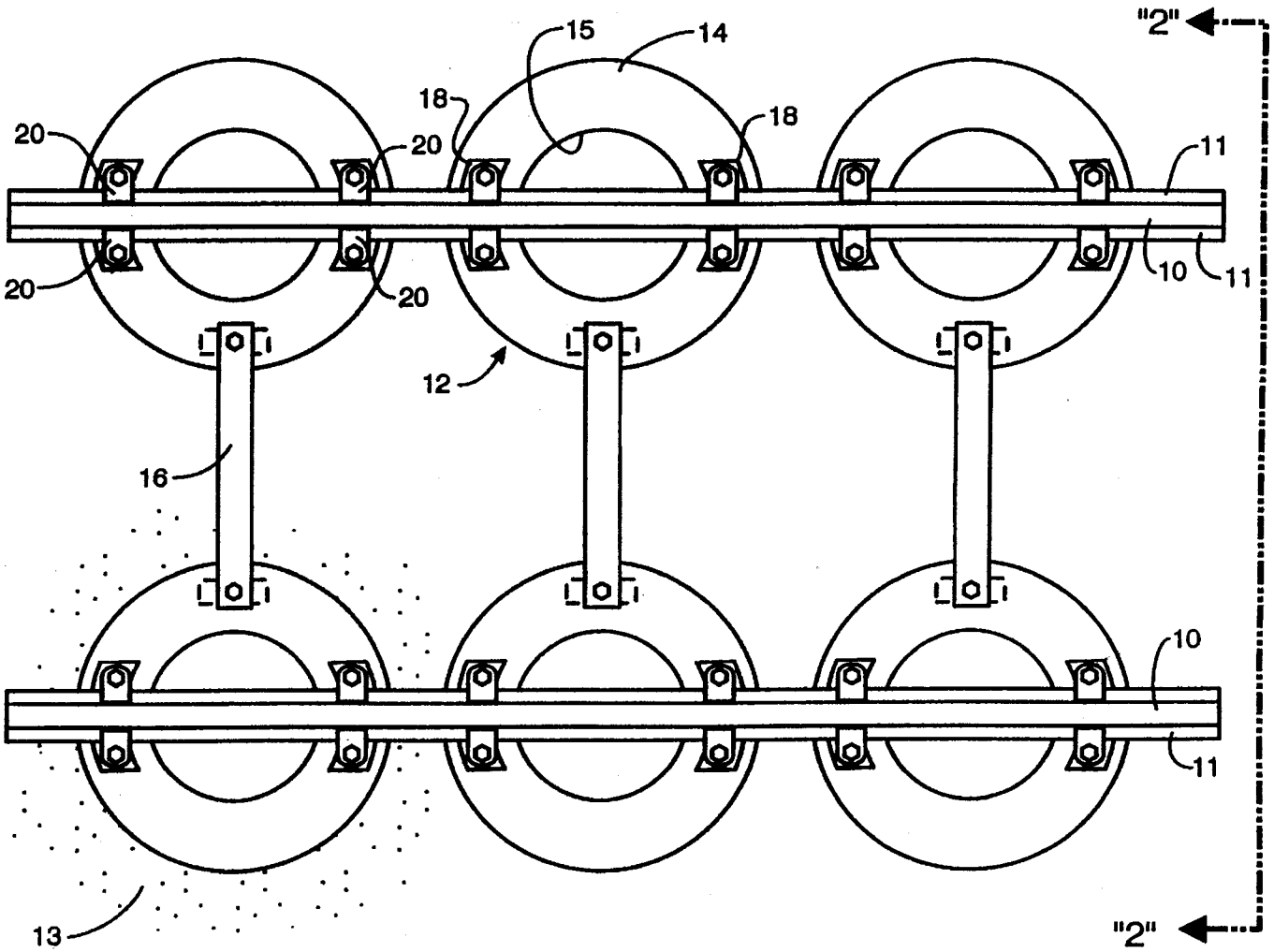
FIG. 1 is a plan view of a section of railway line utilizing ties formed from concrete filled tire bodies in accordance with the present invention.
Figure 2:
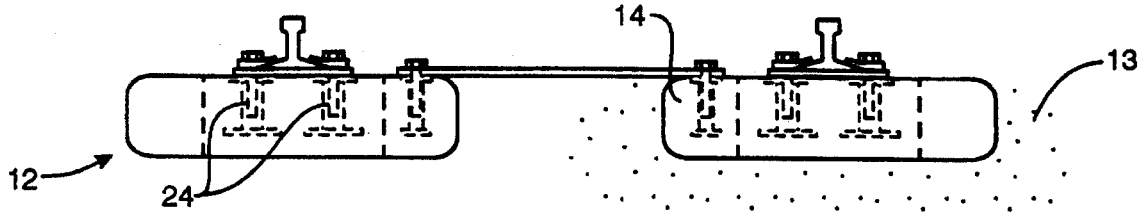
FIG. 2 is a view in elevation taken along line 2—2 of FIG. 1, illustrating details of construction of the tire ties.

Referring to FIG. 1, there is illustrated a section of railway line comprising two parallel metal rails 10, each rail including two outwardly extending lower rail flanges 11. The rails each rest on a plurality of foundation elements or tire ties 12, with opposed pairs of tire ties being interconnected by gage bars. The tire ties are embedded in a roadbed of crushed stone or gravel 17, which comprises ballast means for retaining the tire ties in place. As illustrated in FIG. 2, the crushed stone or gravel ballast is in surrounding relationship to the bottoms of the tire ties, at least part of the tread portions of the tire ties and also is placed inside the central cavity of the tire ties so as to assist in retaining the annular tire ties in position on the roadbed.

Each of the tire ties 12 is formed from the annular body or carcass 14 of an automobile or truck tire, comprising tread portion 17 and upper and lower sidewall portions, 19 and 21, respectfully. Used tires preferably are employed for this purpose. The annular tire bodies are filled with annular concrete cores 23, while the centers or "holes" 15 are left open for receipt of additional crushed stone or gravel ballast. Reinforcing mesh, re-bars or other reinforcing elements may be used in the concrete cores, if desired.

Disposed on the upper sidewall portions of each concrete-filled tire body are a pair of opposed arcuate tie plates 18 on which rest the rails 10. The tie plates function as load distribution means in order to support the rail and to distribute the weight from the rail 10 over a larger area of the tire tie bodies. The arcuate tie plates may include raised bosses which help position the rail 10 and prevent its lateral displacement. Retaining means are provided for making a mechanical connection between the rails and the concrete cores of the tire ties. In a preferred embodiment, such retaining means comprise four hold-down clips 20 which engage the upwardly facing rail flanges 11 on either side of the rail. Four hold-down bolts 22 pass through openings in the clips 20, through mating aligned openings in the tie plates 18, through aligned openings in the sidewall portion of the tire bodies, and threadedly engage anchors 24 embedded in the concrete core.

Figure 4:
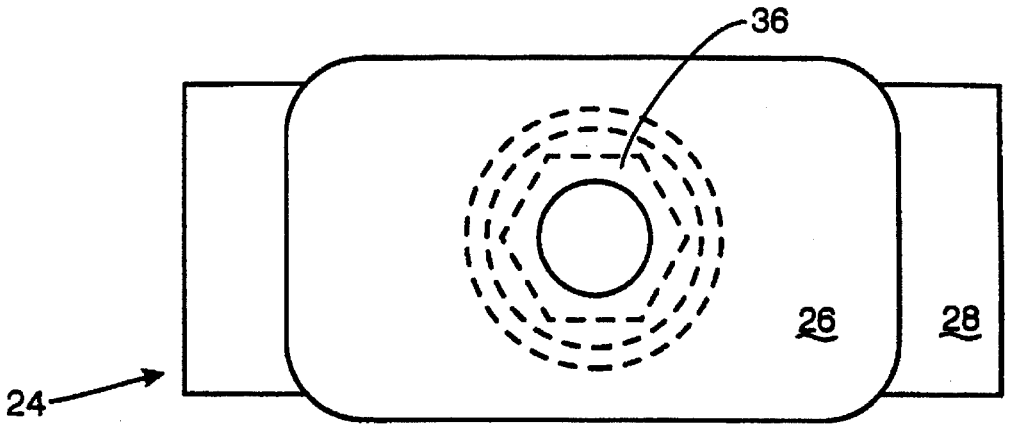
FIG. 4 is an enlarged plan view of an anchor member.
Figure 5:
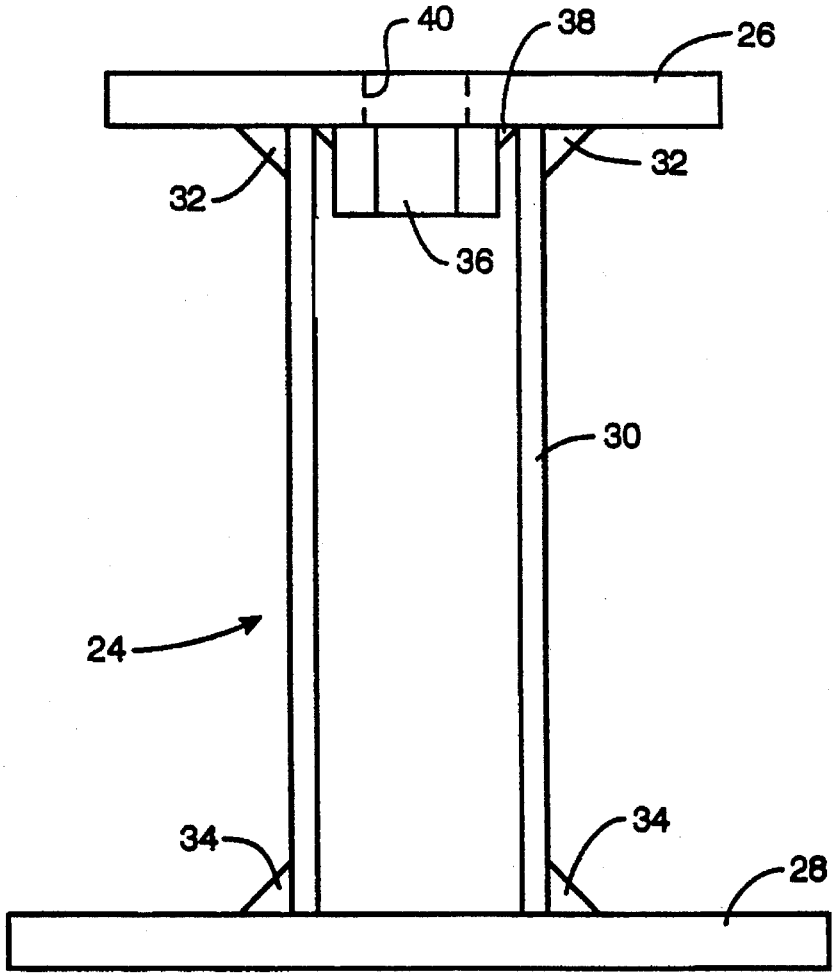
FIG. 5 is an enlarged side elevational view of the anchor member of FIG. 4.

The anchors 24 are shown in greater detail in FIGS. 4 and 5. They comprise upper and lower plates 26, 28, preferably of steel, connected by an elongated tubular spacer 30 which is welded at 32 to the upper plate 26 and at 34 to the lower plate 28. A threaded nut 36 is also welded to the lower face of upper plate 26 by weld 38 and has its threaded opening aligned with an opening 40 in the upper plate 26. Hold-down bolts 22 used to attach the rail 20 and tie plates 18 to the body of the tire tie threadedly engage the nuts 36. The bore of tubular spacer 30 provides room for the lower end of the bolt to move downward as it is tightened.

Figure 3:
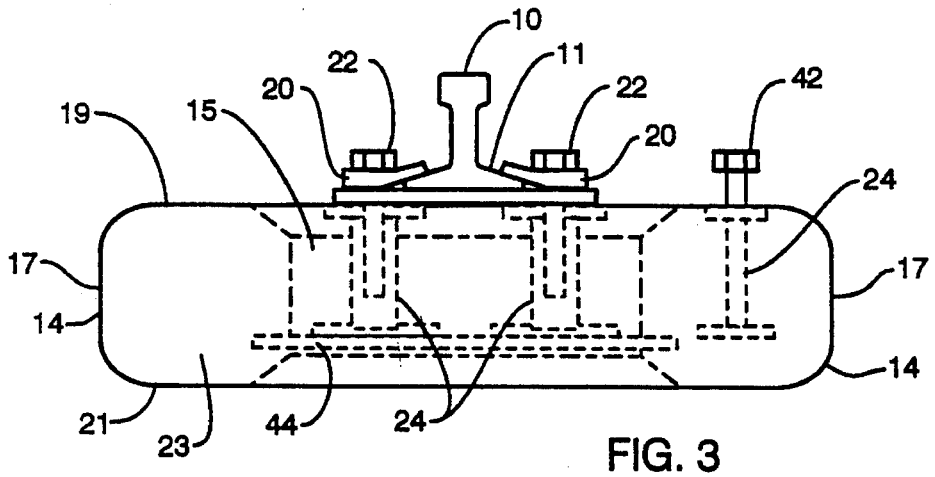
FIG. 3 is an enlarged detail view in side elevation of one of the tire ties, illustrating details of threaded anchors used for anchoring the railroad rail and gage bars to the tie body.
Figure 3A:
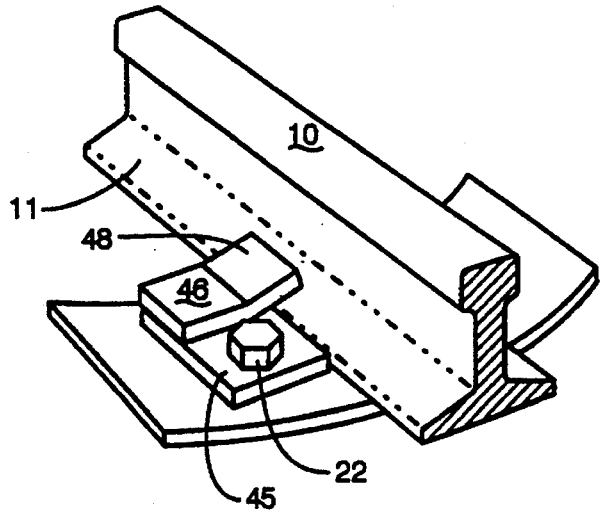
FIG. 3*a* is an enlarged perspective view illustrating an alternate embodiment of the rail hold-down clip used in the present invention.

The hold-down clips 20 may directly engage the rail flanges 11, so that when the hold-down bolts 22 are tightened, the rails will be held in compression against the tie plates 18 and tire bodies 14. Alternatively, it may be desirable in certain applications for the rails to be permitted some vertical displacement with respect to the tie plates 18 and tire ties 12. For example, railroad rails tend to flex vertically somewhat when handling very heavy loads due to compression of the underlying roadbed. If the rails are rigidly retained against the tire ties, the result will be repeated vertical movement of the tire ties in the roadbed. To avoid this, and permit limited vertical movement of the rails 10, an alternate form of hold-down clip may be used, as illustrated in FIG. 3A. It includes a base 44 having an opening for receipt of the hold-down bolt 22. A clip portion 46 is welded to the base 44 and has an inclined portion 48 adapted to cooperate with the rail flange 11. The thickness of the base 44 and the angle of inclination of the inclined portion 48 of the hold-down clip may be configured to allow limited vertical movement of the rail 10 relative to the tie plate 18, before the upwardly facing rail flange 11 engages the clip portion 48, to prevent further vertical displacement of the rail relative to the tie plate 18 and tire tie 12. Even though they permit limited vertical movement of the rails, the clips still comprise means for mechanically connecting the rails to the concrete cores, since they present excessive displacement of the rails.

Four anchors 24 preferably are used for attaching each rail to the tire tie, with two being used for each of the tie plates 18. If desired, the two anchors 24 used for each tie plate may be further reinforced by an interconnecting support, such a length of rebar 44, welded to each of the lower anchor plates 28, or by other suitable means rigidly interconnecting pairs of the anchors 24. For example, two anchors could share an elongated common lower anchor plate, to rigidly interconnect pairs of anchors.

A fifth anchor 24 preferably is embedded in the concrete core approximately 90° around the circumference of the tire body from each of the tie plates 18. It provides means for rigidly attaching gage bars 16 between opposed pairs of tire ties 12, by means of gage bolts 42. Alternatively, the gage bars could extend between, and be attached by, the hold-down bolts 22, or otherwise attached to the tie plates 18 or the concrete core.

In assembling the tire ties in accordance with the present invention, the anchors 24 are placed inside the tie bodies before the tire bodies are filled with concrete. Openings are punched in the tire sidewalls corresponding to the bolt openings in each of the tie plates 18. Bolts are temporarily inserted through the openings in the tie plates, the openings in the tire walls and threadedly engaged with nuts 36 in the anchors to hold the anchors 24 rigidly in place inside the tire bodies, with the upper anchor plates 26 preferably engaging the inside tire walls. Upper anchor plates 26 may be configured to conform to the arcuate tire walls, if desired. The same method is used for placing and retaining the gage anchor inside the empty tire casing.

A cylinder or jig having an outside diameter equal to the inside diameter of the opening 15 in the tire body then is inserted into the tire opening to provide a closed annular space within the tire body for receipt of the concrete. A suitable opening is made, preferably through the tread portion of the tire body, and fluid concrete is poured or pumped into the closed annular area until it is filled with concrete. Alternatively, concrete could be pumped in through a fitting in the cylindrical plug. While a cement/aggregate concrete is preferred, other concretes, such as asphaltic concrete, also can be used. Once the concrete has set, the anchors 24 are rigidly retained in the hardened concrete core in proper spacing for later receipt of the hold-down bolts and gage bolts. The bolts used for temporarily holding the anchors in place then may be removed, along with the tie plates 18.

In constructing a railway line, the tire ties are placed on a prepared roadbed of crushed stone or the like in suitable numbers for distributing the weight of loaded railway cars to the roadbed. Two tie plates are placed on each tire tie and the rails 10 are placed on the tie plates and held in place by hold-down clips 20 and hold-down bolts 22. The tire bodies interposed between the tie plates and concrete cores of the tire ties serve the cushioning purpose of prior art flexible rail pads, and also serve to rigidify and strengthen the structural concrete of the tire tie cores. Gage bars 16 are attached by means of gage bolts 42 to the gage anchors, to complete the assemblage. Additional crushed stone ballast may be placed inside the central openings in the tire ties, as well as around the outside of the tire bodies, to further support and ballast the ties.

Alternatively, the gage bar 16 could be dispensed with and other means relied upon for retaining gage of the railway. For example, conventional wooden railroad ties could be inserted periodically in the line to retain gage or metal gage bars directly engaging the rails could be used for that purpose, with the tire railroad ties being used principally to carry vertical loading.

Referring now to FIGS. 6 through 10, there are illustrated alternate embodiments of the load distribution plates, hold-down clips and anchors used for retaining the railroad rails on the tire railroad ties. FIGS. 6*a* and 6*b* illustrate a load distribution plate 50 which may be formed from one-half of a conventional wooden railroad tie load plate. It includes a flat rectangular base 52 and two parallel raised bosses 54 which define a channel for positioning the base of the railroad flange and for retaining it against lateral displacement. An anchor member 56 is attached to the underside of the plate 50 as, for example, by welds 58 and is used to anchor the load distribution plate 50 to the annular concrete core inside the tire body, as explained hereinafter. The anchor member 56 may be formed, for example, from a conventional elongated steel bolt, a section of rebar material or the like. It may be fitted into a circular opening 60 provided in the base 52 of the load distribution plate or may welded directly to the bottom of the load distribution plate.

Figure 6C:
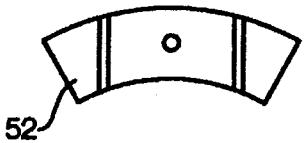
FIG. 6*c* is a plan view of an alternate type of load distribution plate which has an arcuate plan configuration to conform to the annular shape of the tire body.

In FIG. 6*c* is illustrated an alternate embodiment of the load distribution plate in which the base portion 62 is formed in an arcuate shape to conform to the shape of the tire tie body.

Figure 7:
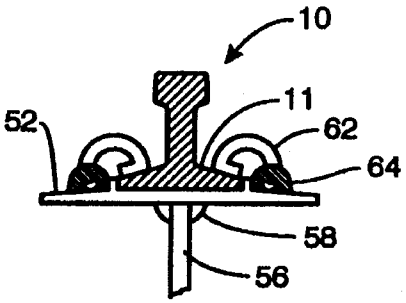
FIG. 7 is a view in side elevation and partly in section illustrating an alternate embodiment of the hold-down clips for retaining the railroad rail on the load distribution plate.
Figure 6B:
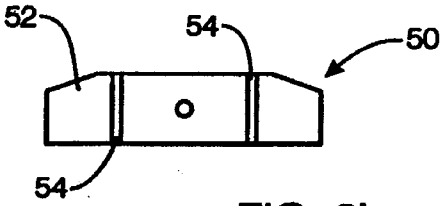
FIG. 6*b* is a plan view of the load distribution plate and bolt of FIG. 6*a*.
Figure 8:
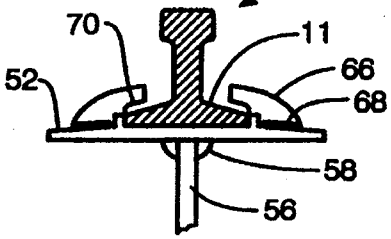
FIG. 8 is a view in side elevation and partly in section illustrating a further alternate embodiment of the hold-down clips.

FIGS. 7 and 8 illustrate alternate embodiments of the hold-down clips for retaining the rail on the load distribution plate 50. In FIG. 7 are illustrated spring clips 62 which are welded to the base plate 52 by welds 64. Their inner ends engage the upper surface of rail flange 11, so that the spring clips 62 provide resilient means for retaining the rail on the load distribution plate 50, while permitting limited vertical movement of the rail with respect to the load distribution plate. In FIG. 8 are illustrated rigid retaining clips 66 which are welded to the load distribution plate 50 by welds 68. The clips 66 extend above and inboard of the rail flanges 11, but provide a clearance 70 between the lower surface of the clip and the upper surface of the rail flange 11, so that the clips provide means for retaining the rail flange on the load distribution plate 50, while permitting limited vertical movement of the rail with respect to the load distribution plate and tire tie.

Figure 9:
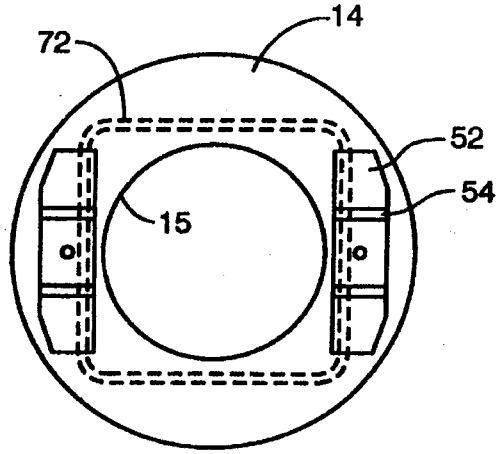
FIG. 9 is a plan view partly in phantom illustrating use of the load distribution plate of FIGS. 6*a* and 6*b* on a tire carcass railroad tie.
Figure 10:
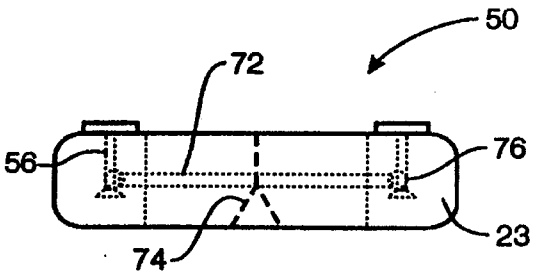
FIG. 10 is a view in side elevation of the tire carcass railroad tie and load distribution plate of FIG. 9.
Figure 6A:
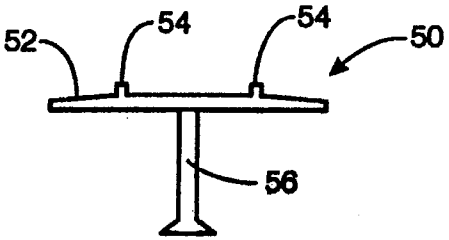
FIG. 6*a* is a view in side elevation of an alternate embodiment of the load distribution plate with an anchor bolt rigidly attached to the underside of the load distribution plate.

As illustrated in FIGS. 9 and 10, a pair of load distribution plates 50 are disposed on the sidewall portions of tire body 14 on opposite sides of the central opening 15. The anchor rods 56 extend through an opening in the sidewall portion of the tire body. If desired, reinforcing means such as rebar 72 also may be placed in the annular tire body and supported, for example, by one or more supports 74 (FIG. 10) or by fastening to the anchors 56 as illustrated at 76. The central opening 15 in the tire body then is closed by a cylinder or jig having an outside diameter equal to the inside diameter of the opening to provide a closed annular space within the tire body for receipt of the concrete. A suitable opening is made through the tire body or through the cylinder or jig enclosing the central opening and fluid concrete is poured or pumped into the closed annular area until it is filled with concrete. Once the concrete is set, the anchors 56 are rigidly retained in the hardened concrete core 23 and the load distribution plates 50 are rigidly retained on the tread portions of the tire bodies 14.

The tires then may be placed on a prepared roadbed of crushed stone ballast or the like in suitable numbers for distributing the weight of a loaded railway car to the roadbed. The rails are laid across the aligned load distribution plates 50 and suitable retaining clips are then welded onto the load distribution plates to retain the rails in place. Alternatively, other means of fastening the retaining clips, such as threaded fasteners, may be used. If desired, gage bars may extend between opposing pairs of tire ties as described in conjunction with the FIGS. 1 through 5 embodiments. Alternatively, other means, such as spaced conventional wooden railroad ties, metal gage bars or the like may be used for retaining gage between rails. Additional crushed stone ballast preferably is placed around the tread portions of the tire bodies as well as in the central openings 15 to further support and ballast the ties.

While the tire ties of the present invention are disclosed in their preferred embodiment as foundation elements for a railway line, it will be apparent to those skilled in the art that they also may serve as foundation elements for other purposes. In a variety of applications, such as those involving temporary or movable structures, skid mounted equipment, temporary roadbed construction, and the like, it is conventional practice to use timbers, concrete pads or other footing elements resting at or just below grade as foundation supports or footings. In many such applications, tire ties in accordance with the present invention could serve as substitutes for the timbers, concrete blocks, pads, etc. used in such applications and, additionally, would have the advantage of providing means for mechanically attaching the foundation elements to the structure being supported. This would provide an advantage over many grade foundation systems now in use which lack any means for attaching the overlying structures to the foundation elements.

The foregoing disclosure and description of the invention is illustrative only, and various changes may be made in the details of the illustrated construction, within the scope of the appended claims, without parting from the spirit of the invention.

What is claimed is:

1. A foundation element for a load-bearing structure, said foundation element comprising:

an annular tire body having a tread portion and a sidewall portion surrounding a central opening;

an annular concrete core filling at least a portion of said annular tire body and having a central opening aligned with said central opening in said tire body; and means for providing a mechanical connection through said sidewall portion of said tire body between a structure resting on said foundation element and said annular concrete core.

2. The apparatus according to claim 1 comprising additionally load distribution means adapted to be disposed between said load-bearing structure and the sidewall portion of said tire body, for distributing the load imposed by said structure over part of said sidewall portion of said tire body.

3. The apparatus according to claim 1 wherein said load-bearing structure is a railroad rail.

4. A foundation element for supporting a railroad rail comprising:

an annular tire body having a tread portion and a sidewall portion surrounding a central opening;

an annular concrete core filling at least a portion of said annular tire body and having a central opening aligned with said central opening in said tire body;

load distribution means for supporting said rail on said sidewall portion of said tire body and for distributing a load imposed by said rail over a part of said sidewall portion of said tire body; and retaining means for retaining said load distribution means and said rail on said tire body and for anchoring said load distribution means and said rail to said concrete core.

5. The apparatus according to claim 4 wherein said load distribution means comprises a metal tie plate adapted to be disposed between said rail and said annular tire body sidewall, said plate having a pair of aligned bosses defining a channel for receiving a railroad rail.

6. The apparatus according to claim 5 wherein said retaining means comprise anchor means rigidly attached to said metal plate and extending through said sidewall portion of said tire body and into said annular concrete core and a pair of metal hold-down clips attached to the upper side of said tie plate on opposed sides of said channel and adapted to retain said rail in said channel.

7. The apparatus according to claim 6 wherein said hold-down clips comprise resilient members adapted to flex to permit limited vertical movement of said rail relative to said tie plate.

8. The apparatus according to claim 6 wherein said hold-down clips comprise rigid members having portions extending above, and spaced vertically from, an upper surface of said rail, so as to permit limited vertical movement of said rail relative to said tie plate.

9. The apparatus according to claim 5 wherein tie plates are substantially rectangular.

10. The apparatus according to claim 5 wherein said tie plates have an arcuate configuration to conform to the shape of said sidewall portion of said tire body.

11. The apparatus according to claim 4 comprising additionally means for attaching a gage bar to said foundation element, whereby pairs of said foundation elements may be retained in predetermined horizontal spacing, for maintaining a proper gage between pairs of rails carried by said opposed pairs of foundation elements.

12. A railroad construction comprising:

first and second elongated metal rails in spaced parallel relationship, each said rail having a rail flange;

a plurality of tire ties supporting each said rail, each said tire tie comprising, an annular tire body having a tread portion and upper and lower sidewall portions surrounding a central opening, an annular concrete core filling at least a portion of said annular tire body and having a central opening aligned with said central opening in said tire body, a pair of load distributing tie plates disposed on said upper sidewall portions of said tire bodies on opposite sides of said central opening for supporting said rails on said tire ties and for distributing the load imposed by said rail across a portion of each said tire tie, anchor means for anchoring each said tie plate to said annular concrete core, and hold-down clips attached to said tie plates and extending above said rail flange so as to retain said rail in position on said tie plates; and ballast disposed in surrounding relationship to at least part of said tread portions of said tire ties and filling at least a portion of said central openings defined by said tire bodies and said annular concrete cores.

13. The apparatus according to claim 12 wherein said hold-down clips permit limited vertical movement of said rail relative to said tie plates.

14. The apparatus according to claim 12 comprising additionally gage means connecting a tire tie under said first rail to a tire tie under said second rail, for maintaining a predetermined gage spacing between said rails.

15. The apparatus according to claim 12 wherein each said metal tie plate includes a pair of parallel bosses defining a rail channel and wherein said rails engage aligned channels in said pair of tie plates on each said tire tie.

* * * * *